US009060608B2

(12) United States Patent
Brent

(10) Patent No.: US 9,060,608 B2
(45) Date of Patent: Jun. 23, 2015

(54) SUPPORT BRACKET AND METHOD OF USE

(76) Inventor: Harper Brent, Blackfoot, ID (US)

( * ) Notice: Subject to any disclaimer, the term of this patent is extended or adjusted under 35 U.S.C. 154(b) by 361 days.

(21) Appl. No.: 13/365,174

(22) Filed: Feb. 2, 2012

(65) Prior Publication Data

US 2012/0199713 A1 Aug. 9, 2012

Related U.S. Application Data

(60) Provisional application No. 61/439,332, filed on Feb. 3, 2011.

(51) Int. Cl.
*A47B 96/06* (2006.01)

(52) U.S. Cl.
CPC ..... *A47B 96/06* (2013.01); *A47B 96/063* (2013.01)

(58) Field of Classification Search
USPC ..... 211/182; 248/220.1, 250, 225.11, 248/223.41; 108/27; 312/238, 140.3, 140.4; 403/231, 205, 403
See application file for complete search history.

(56) References Cited

U.S. PATENT DOCUMENTS

| | | | | | |
|---|---|---|---|---|---|
| 3,606,229 | A * | 9/1971 | Wall | 248/345 |
| 3,799,109 | A * | 3/1974 | Vargo | 116/314 |
| 4,665,676 | A * | 5/1987 | Drzemala | 52/656.9 |
| 4,805,860 | A | 2/1989 | Holstrom | |
| 4,812,075 | A * | 3/1989 | Lavin, Sr. | 403/403 |
| D373,070 | S | 8/1996 | Kriegstein | |
| 5,671,852 | A * | 9/1997 | Maharg | 211/189 |
| D482,954 | S | 12/2003 | Hoernig | |
| D484,780 | S | 1/2004 | Barile, Sr. | |
| D517,403 | S | 3/2006 | Chen | |
| D566,994 | S | 4/2008 | Marcus | |
| D623,500 | S | 9/2010 | Langner et al. | |
| D639,142 | S | 6/2011 | Antonic | |
| 8,414,068 | B1 * | 4/2013 | Na et al. | 296/193.06 |
| 8,562,084 | B2 * | 10/2013 | Chen | 312/296 |
| 2005/0016945 | A1 * | 1/2005 | Yang et al. | 211/181.1 |
| 2009/0020669 | A1 * | 1/2009 | Wang | 248/220.1 |
| 2010/0127140 | A1 * | 5/2010 | Smith | 248/220.1 |

OTHER PUBLICATIONS

U.S. Appl. No. 29/384,805, Harper.

* cited by examiner

*Primary Examiner* — Alfred J Wujciak
(74) *Attorney, Agent, or Firm* — Bateman IP

(57) ABSTRACT

An improved support bracket is provided which may include a channel having spaced top and bottom walls and a connecting wall having a first and second end. The bracket may include at least one engagement member for releasably engaging a structural member, such as shelving, and a guide to facilitate attachment of the bracket to the structural member. The connecting wall of the bracket may be bent or angled. Thus, the bracket may releasably engage at least two structural members disposed at an angle relative to each other such that the inner surface of the connecting wall is substantially flush with the outer edge of the structural members. Brackets may be made such that the connecting wall is bent or angled to different degrees.

17 Claims, 8 Drawing Sheets

SUPPORT BRACKET AND METHOD OF USE

RELATED APPLICATIONS

The present application claims the benefit of U.S. Provisional Application Ser. No. 61/439,332, filed Feb. 3, 2011, which is incorporated herein in its entirety.

THE FIELD OF THE INVENTION

The present invention relates to brackets. More specifically, the present invention relates to an improved support bracket which may be used to provide structural support for shelving, and methods of using said improved support bracket.

BACKGROUND

Shelving units, storage organizers, and other storage systems are well known in the art. Such systems commonly are comprised of multiple structural elements, such as shelves, connected together. Some are adjustable and can be arranged and configured in various ways within a storage space such as a closet. If such systems are not properly supported, however, over time the joint formed by two adjoining structural elements may become uneven due to one structural element sagging relative to the other. Thus, shelving units, storage organizers, and other storage systems are commonly supported with various brackets or the like. One disadvantage of using brackets, however, is that readjusting or rearranging such systems after installation can be more difficult.

Brackets used to support shelving units, storage organizers, and other storage systems are typically comprised of a piece of metal cut in the shape of an L or a T and designed to span the joint created by two structural members such as shelves abutting each other, or to a linear bracket that wraps around the shelf joint such as that shown in U.S. Pat. No. 4,805,860. The brackets are typically secured to the structural member using screws, nails or the like. If a screw or nail is improperly inserted during installation it may damage the structural member and/or detract from the overall aesthetics of the shelving or storage unit. Moreover, the screws or nails may not be flush with the outer surface of the bracket and, therefore, damage clothing, blankets, or other items that are stored on the units or shelves. For example, when being removed from the units or shelves, clothing, blankets, or other items may snag on the head of the screw or nail.

Thus there is a need for an improved support bracket and method of using the same. The improved support bracket should be easy to use and allow for quick readjustment of shelving or other structural members. Also, the improved support bracket should not detract from the overall appearance of the shelving system or storage unit and minimize potential damage to items being stored thereon.

SUMMARY OF THE INVENTION

It is an object of the present invention to provide an improved support bracket.

According to one aspect of the present invention an improved support bracket is provided which may be configured for engagement with a joint formed by two adjoining structural members, such as shelves.

According to another aspect of the present invention an improved support bracket is provided which may include a channel having spaced top and bottom walls and a connecting wall having a first and second end.

According to another aspect of the present invention the connecting wall of the improved support bracket may be disposed at a plurality of angles so that the top and bottom walls forming the channel extend away from the connecting wall in at least two directions. Thus, the channel may be positioned to receive two adjoining structural members having outer edges, such as shelves, disposed at an angle relative to each other. The angle defined by the two adjoining structural members may be complementary to the angle of the connecting wall of the bracket. Thus, the inner surface of the connecting wall of the bracket may be substantially flush with the outer edges of the two adjoining structural members when the support bracket is engaged with the two adjoining structural members.

According to another aspect of the present invention an improved support bracket may include at least one engagement member, such as a dowel pin, rod, peg, etc., for engaging a structural member.

According to another aspect of the present invention an improved support bracket may include at least one guide to facilitate proper engagement of the support bracket with two adjoining structural members.

According to still another aspect of the present invention an improved support bracket may include a channel, an engagement member, and a guide for facilitating proper engagement of the support bracket with two adjoining structural members. The engagement member may be disposed on the connecting wall and extend into the channel formed by the top and bottom walls of the bracket, and the guide may be an aperture extending through the connecting wall.

In accordance with one aspect of the present invention the connecting wall of an improved support bracket may be disposed at an angle and may include an engagement member extending into the channel from a first end of the connecting wall. The improved support bracket may also include a guide extending through a second end of the connecting wall and located so as to facilitate proper engagement of the bracket with two adjoining structural members disposed at an angle complimentary to the angle of the connecting wall. The guide may be used to locate the proper position on the structural member to create a receiving member, e.g. a hole, cavity, or the like, which is configured to receive the engagement member in a manner the allows the inner surface of the connecting wall to be substantially flush with the outer edge of the two adjoining structural members when the support bracket is fully engaged with the structural members.

According to yet another aspect of the present invention a method of using an improved support bracket may include positioning the support bracket adjacent two adjoining structural members. The support bracket may include spaced apart top and bottom walls and a connecting wall comprising an engagement member and a guide. The method may also include using the guide to find a location on one of the two adjoining structural members where a receiving member is to be made. The method may also include removing the support bracket from the structural members and making the receiving member at the identified location. The method may also include repositioning the support bracket such that the inner surfaces of the connecting wall are substantially flush with outer edges of the two adjoining structural members such that the support bracket is fully engaged with the two adjoining structural members.

According to another aspect of the present invention, an improved support bracket may include top and bottom walls which are generally arcuate and broadly rounded to provide both an aesthetically pleasing design and to reduce the risk of an item on a shelf catching on the top or bottom wall of the support bracket.

According to another aspect of the present invention an improved support bracket is provided that that can be economically manufactured and is attractive in appearance.

These and other aspects of the present invention may be realized in an improved support bracket as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
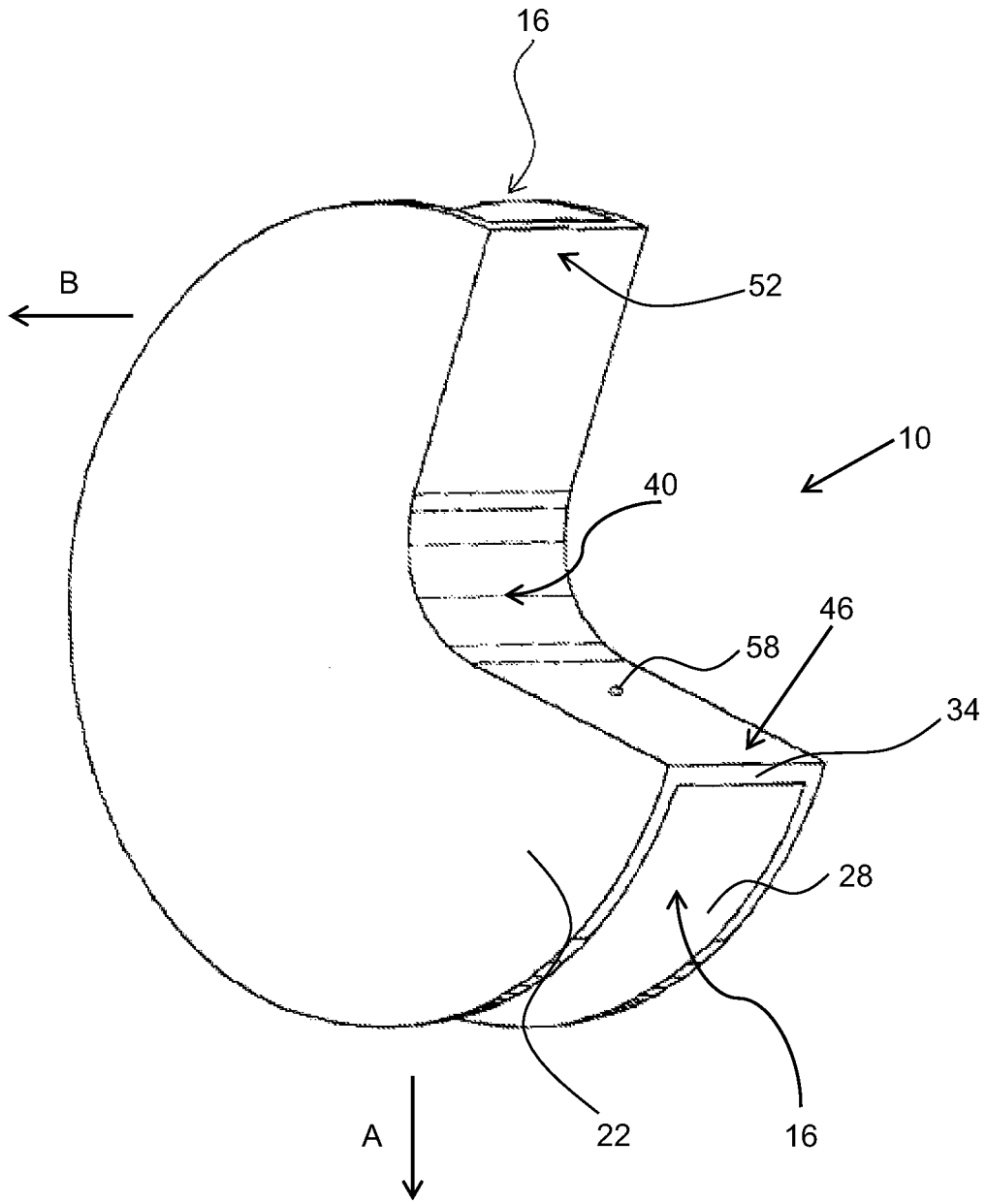
FIG. 1A shows a side, perspective view of an improved support bracket made in accordance with principles of the present invention.
Figure 1B:
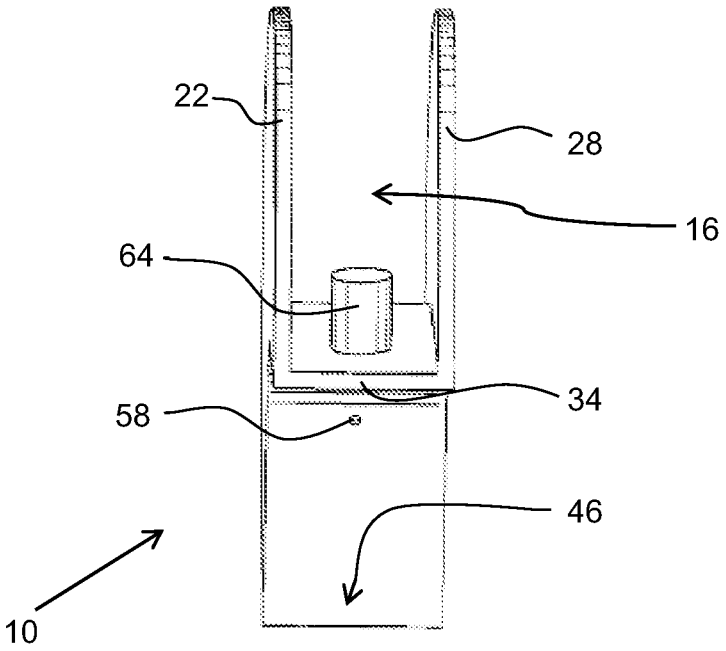
FIG. 1B shows an end, perspective view of the improved support bracket of FIG. 1A.

Turning now to FIGS. 1A and 1B, perspective views of an improved support bracket, generally indicated at 10, made in accordance with principles of the present invention are shown. The improved support bracket 10 may include a channel 16 defined bay top wall 22 and bottom wall 28 spaced a distance apart, and a connecting wall 34 having a first end 46 and second end 52. The connecting wall 34 may be angled or bent along a mid-portion thereof, such as is shown at angle or bend 40, so that the top wall 22 and bottom wall 28 forming the channel 16 extend away from the connecting wall 34 in at least two directions (indicated by arrows A and B), which may be perpendicular to one another. Although connecting wall 34 is shown to be angled or bent to about 90 degrees, other brackets may have connecting walls less angled than about 90 degrees or more angled than about 90 degrees to accommodate different shelving configurations. As discussed in more detail below, brackets having connecting walls more or less angled than about 90 degrees may be used to support shelving pieces which are not disposed perpendicular to each other.

The support bracket 10 can be formed from composite materials, cast metal or other appropriate materials which will be known to those of skill in the art in light of the present disclosure. One advantage of at least one configuration of the present invention is that the top wall 22, bottom wall 28 and connecting wall 34 provide increased surface area in contact with shelving pieces or the like. At the same time, the shape thereof may be used to reduce the risk of an item snagging on the support bracket.

The improved support bracket 10 may include at least one engagement member 64 (FIG. 1B), such as a dowel pin, rod, peg, etc., for engaging a structural member, such as a shelf. The support bracket 10 may also include a guide 58 to facilitate proper engagement of the support bracket 10 with two adjoining structural members, which will be discussed in more detail below. It will be appreciated that that a bracket 10 according to principles of the present invention may include a plurality of engagement members 64 and/or guides 58.

Figure 2A:
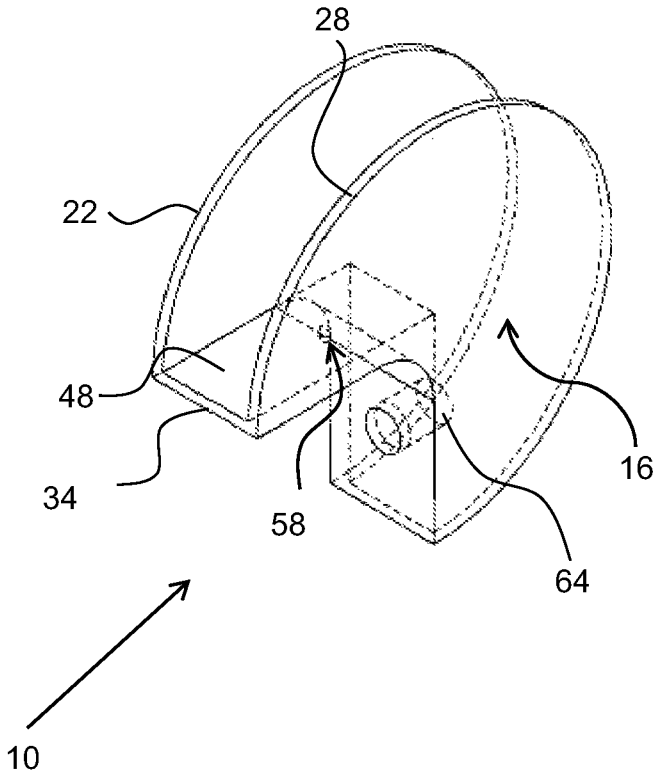
FIG. 2A shows another perspective view of an improved support bracket.

Turning now to FIG. 2A, there is shown a perspective view of an improved support bracket 10 made according to principles of the present invention, with obstructed structures being shown by dashed lines. The connecting wall 34 may be disposed at an angle (such as at curved mid-section 40) equal to about 90 degrees. Thus, for example, if two structural members are positioned adjacent each other in a corner of a square room to form a 90 degree angle where the two structural members abut each other, then the inner surface 48 of the connecting wall 34 of the bracket 10 would be substantially flush with the outer surface of the two structural members when the bracket 10 engages or is attached to the two structural members (shown more clearly in FIG. 3). The attachment of the bracket 10 may be releasable or may be fixed (e.g. attach using nails, screws, glue or other more permanent fasteners).

Figure 2B:
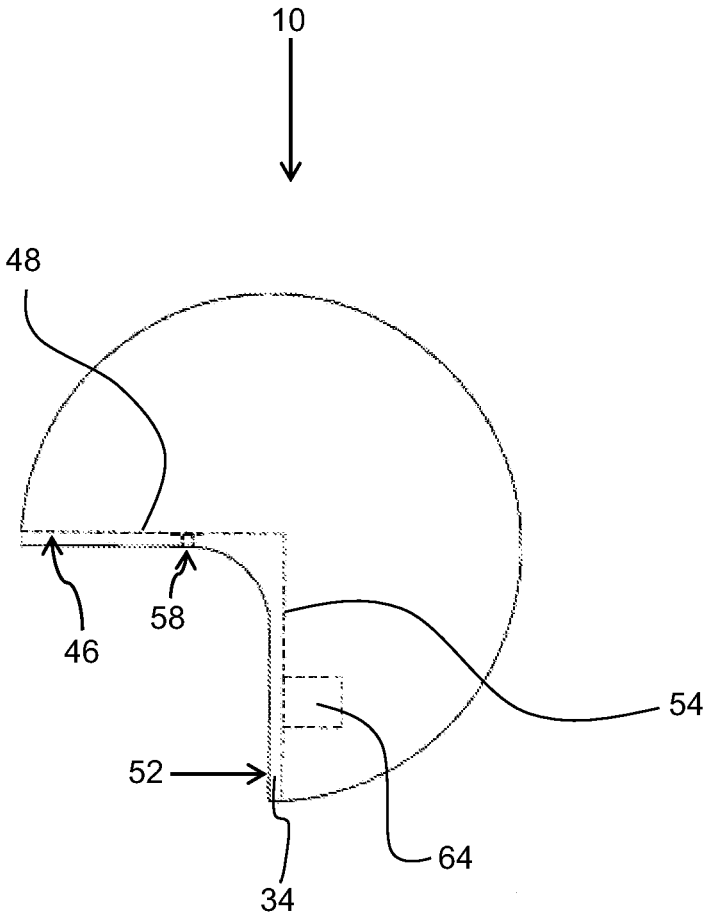
FIG. 2B shows a side view of the improved support bracket of FIG. 2A.
Figure 2C:
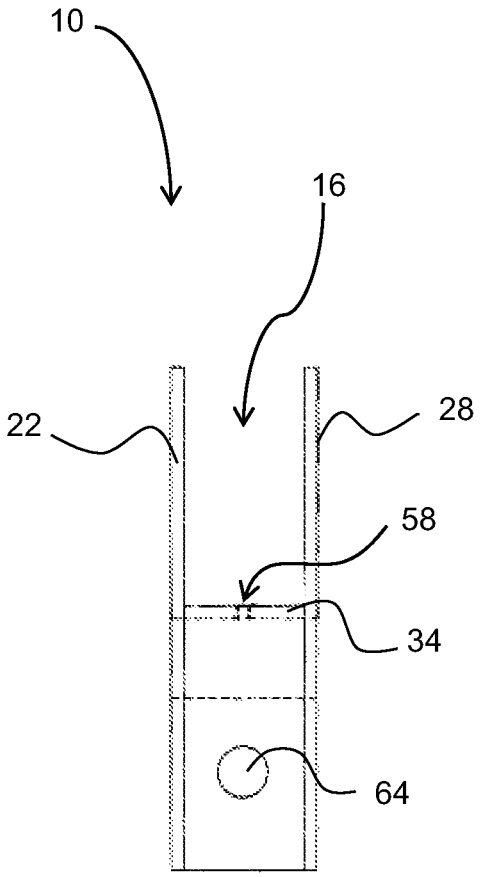
FIG. 2C shows an end view of the improved support bracket shown in FIGS. 2A and 2B.

One of ordinary skill in the art will appreciate that the bracket 10 of the present invention may include a connecting wall 34 disposed at a variety of angles so that structural members disposed at angles other than 90 degrees relative to each other may be received in the channel 16 (as is best seen in FIG. 2C) in a manner allowing inner surfaces 48 and 54 (FIG. 2B) to be substantially flush with such structural members.

Turning now to FIG. 2B, there is shown a side view of the improved support bracket 10 of FIG. 2A with internal structures shown by dashed lines. Extending away from the inner surface 54 of the connecting wall 34 is an engagement member 64. The engagement member 64 may be a dowel pin, rod, peg, etc. A guide 58 is shown as an aperture extending through connecting wall 34. For reasons explained in further detail below, the guide 58 is positioned further away from end 46 of connecting wall 34 than the engagement member 64 is from end 52. This difference will typically be about the length of the engagement member.

The guide 58 is intended to facilitate engagement of the engagement member 64 with a structural member which is to be supported. Inserting a nail, screw of other marking device into the guide 58 may be used to place a mark on a shelf or other structural member, which then can be drilled out or otherwise modified so as to provide a receiving member for receiving the engagement member 64. The guide 58 should be placed inwardly a distance further from the end 46 than a distance the engagement member 64 is placed relative to end 52 by about the length of the engagement member 64.

As will be explained in additional detail below, in order to determine the proper location of a hole on one of the structural members for receiving the engagement member 64, the bracket is turned upside down and advanced so that the engagement member 64 abuts one structural member and the guide 58 is positioned adjacent the other structural member. When the bracket 10 is so positioned, a mark can be made on the structural member by inserting a nail, pen, etc., through the guide 58. The support bracket 10 can then be removed and a hole drilled, or an alternate receiving member otherwise formed, at the location of the mark on the structural member. The support bracket 10 can then be flipped over so that the engagement member 64 aligns with the hole or other receiving member and advanced so that the engagement member nests in the receiving member and the walls 22 and 28 engage the adjacent structural members. A nail, screw, tacks or the like can also be advanced through the guide member to further secure the support bracket 10 to the at least two structural members if desired. (Reference is made to at least two structural members; however, three structural members could come together and engage the support bracket 10 in some shelving and other configurations.

Figure 3:
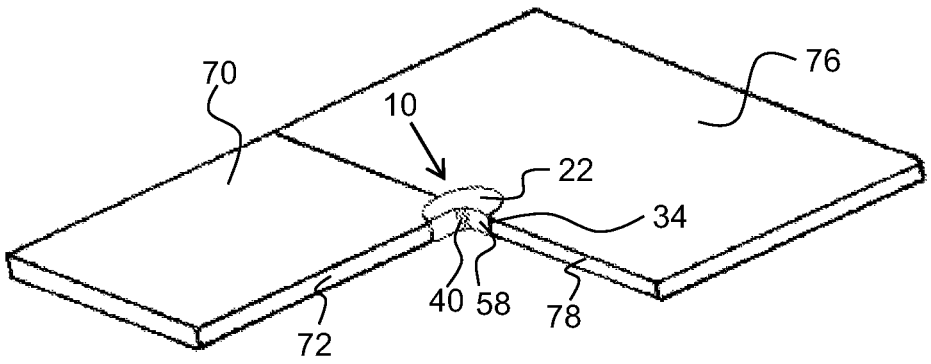
FIG. 3 shows a perspective view of an improved support bracket removably engaged with two adjoining structural members according to principles of the present invention.

Turning to FIG. 3, there is shown a perspective view of the improved support bracket 10 removably attached to two adjoining structural members 70 and 76. A connecting wall 34 of the support bracket 10 may be formed at an angle at a location, indicated by reference numeral 40, which is complimentary to the angle formed by outer edges 72 and 78 of structural members 70 and 76. Thus the inner surfaces (reference numerals 48 and 54 in FIG. 2B) of the connecting wall 34 may be substantially flush with the outer edges 72 and 78 of the structural members 70 and 76. As can be seen, the bracket 10 is removably attached to, and supporting, the structural members 70 and 76 without the use of screws, nails, tacks, or the like. Also, the outer surfaces of the bracket 10 may be substantially smooth and free of irregularities which may snag clothing, blankets, or other items that are stored on the structural members 70 and 76 and thereby reducing the likelihood that such items will be damaged when removed from the structural members 70 and 76. Furthermore, the smooth surfaces of the bracket 10 may not detract from the overall appearance of a storage unit or shelving systems.

While the support bracket 10 is preferable supported in place by the engagement member 64, it will be appreciated that other attachment mechanisms such as adhesives or even nails extending through the support wall 34 could be used if desired. Thus, the engagement member 64 may be omitted from the support bracket in some configurations.

Figure 4A:
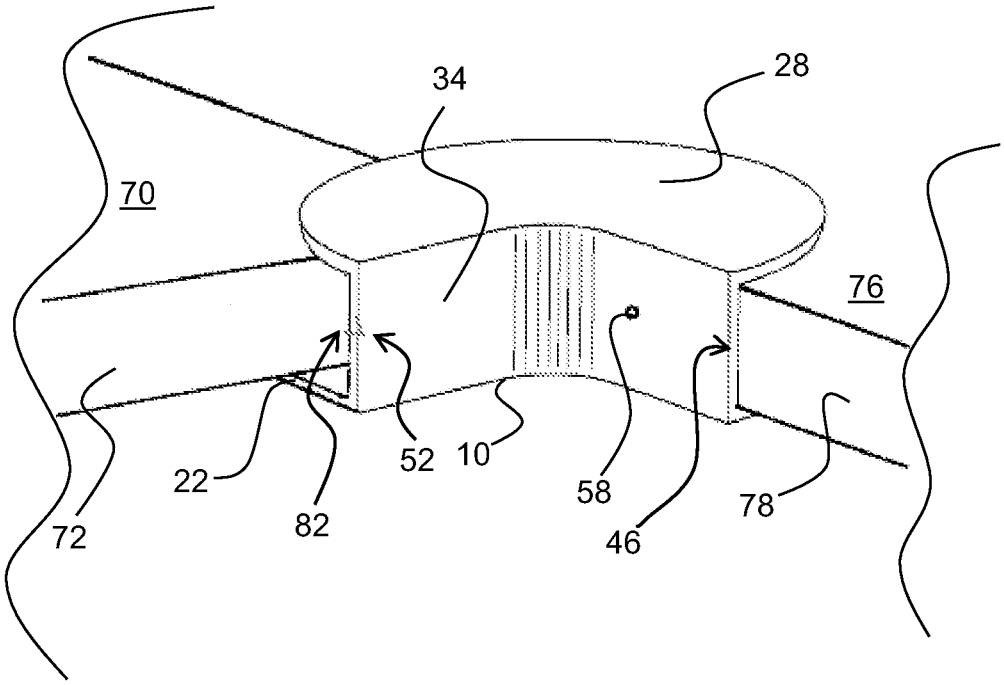
FIG. 4A shows a fragmented, perspective view of an improved support bracket disposed adjacent two adjoining structural members so as to position a guide.

Referring now to FIG. 4A, there is shown a fragmented, perspective view of an improved support bracket 10 disposed adjacent two adjoining structural members 70 and 76 so as to properly position the guide 58. The guide 58 may be an aperture extending through a portion of the connecting wall 34 adjacent the end 46 and may be used to locate the proper position for making a receiving member in the outer edge 78, such as a hole or cavity intended to receive an engagement member (not shown), which may extend from an inner surface of connecting wall 34 at a portion adjacent the end 52. (It will be appreciated that, in the alternative, the guide 58 may be positioned adjacent the outer edge 72 for making the receiving member on outer surface 72). To locate the proper location for making the hole or cavity in the outer edge 78, the bracket 10 is turned upside down so that the bottom wall 28 is in contact with the upper surfaces of the structural members 70 and 76. Because the engagement member 64 extends from the inner surface of the connecting wall 34 on the end 52, there is a space 82 between the connecting wall 34 and the outer edge 72 at the end 52. In contrast, the connecting wall 34 may be substantially flush with the outer edge 78. Thus, the guide 58 should be located a further distance from the end 46 of the connecting wall 34 than is the engagement member from the end 52 to accommodate for the distance of space 82 when locating the proper place for making a hole or cavity in the outer edge 78.

Once the bracket 10 is positioned as shown in FIG. 4A, a mark can be made on the outer edge 78 by inserting a pen, nail, or the like, through guide 58 to contact the outer edge 78. The bracket 10 can then be removed from the structural members 70 and 76 and a receiving member such as a hole, cavity or other structure can be created in the outer edge 78, which is sufficient to receive an engagement member associated with the bracket 10 at an inner surface of the connecting wall 34 adjacent the end 52. Typically, the receiving member will comprise a hole or cavity created using a drill bit and drill. However, other methods of making a receiving member in the outer edge 78 which are known in the art may be used.

Figure 4B:
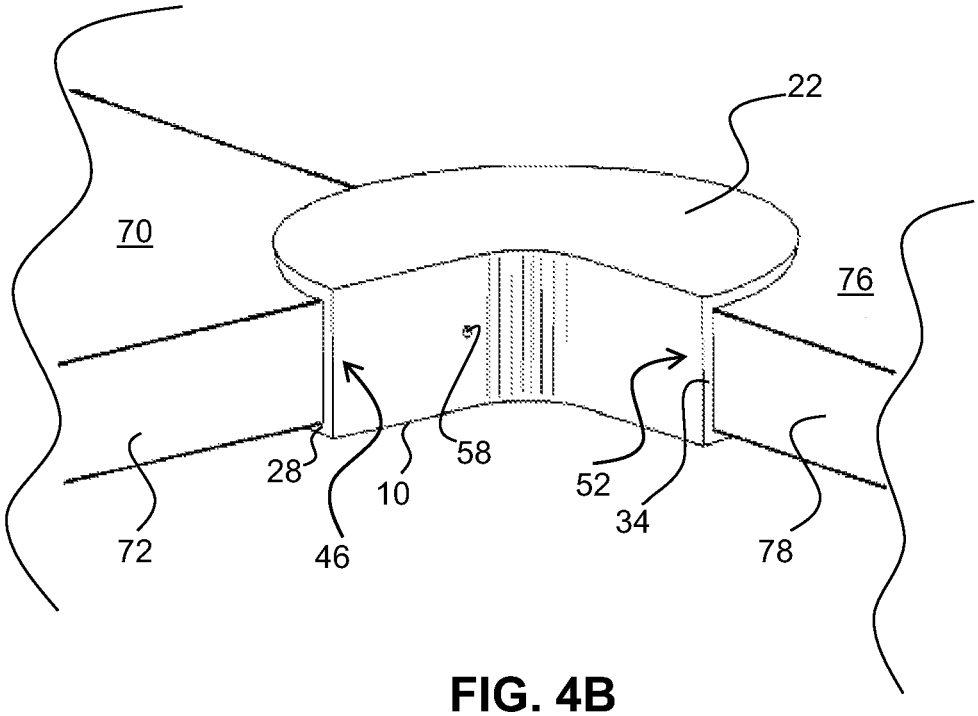
FIG. 4B shows a fragmented, perspective view of the improved support bracket, shown in FIG. 4A, fully engaged with the two adjoining structural members.

To fully engage the bracket 10 with the structural elements 70 and 76, the bracket 10 may be flipped over and advanced so that the upper wall 22 is in contact with the upper surfaces of the structural elements 70 and 76 and the outer edges 72 and 78 are received in the channel 16 of the bracket 10, as can be seen in FIG. 4B. Because the engagement member is received in, for example, a hole or cavity created in the outer edge 78, the inner surfaces of the connecting wall 34 at both ends 46 and 52 are substantially flush with the outer edges 72 and 78 of the structural elements 70 and 76. When the bracket 10 is fully engaged with the structural elements 70 and 76, as shown in FIG. 4B, the bracket 10 provides support while not detracting from the overall appearance of a storage unit or shelving system.

The bracket 10 of the present invention may be readily removable to allow for easy and fast readjustment of the structural members 70 and 76. For example, if a person desires to move a shelving system to a different corner of the room, the bracket 10 can be quickly detached to allow for disassembly of the structural members 70 and 76. The structural members 70 and 76 can then be reassembled in the different corner and the support bracket 10 reattached.

It will be appreciated that use of designations such as first end and second end is for illustrative purposes only and that a guide and engagement member associated with a bracket of the present invention may be located on any given side of said bracket. Similarly, the upper wall and bottom wall of the bracket could refer to the opposite sides as discussed above resulting only in a hole or cavity being created, for example, in the outer edge 72 of structural element 70 as opposed to the outer edge 78 of the structural element 76. One of skill in the art will also appreciate that a bracket having multiple guides and multiple engagement members comes within the scope of the present invention.

It will be appreciated that the connecting wall 34 may be of a variety of heights so as to accommodate shelves and other structural elements having different thicknesses. For example the space between the upper wall and the lower wall may be $3/8^{th}$ inch, $1/4^{th}$ inch, ½ inch, ¾th inch, 1 inch and other distances to accommodate the various thicknesses of shelving and other structural members commonly used.

There is thus disclosed an improved support bracket and method of using the same. It will be appreciated that numerous changes may be made to the present invention without departing from the scope of the claims.

What is claimed is:

1. A support bracket for supporting a shelf, comprising:

a channel defined by an upper wall, a bottom wall, and a connecting wall, the connecting wall having an inner surface extending along the channel;

a guide located on a first portion of the connecting wall; and an engagement member located on a second portion of the connecting wall; and wherein the upper wall and the bottom wall are connected by the first portion of the connecting wall and the second portion of the connecting wall without an intervening connecting wall along the channel and wherein the inner surface disposed along the first portion of the connecting wall and the inner surface extending along the second portion of the connecting wall are disposed at an obtuse angle measured along the channel, wherein the upper wall and the bottom wall are each formed in a pie shape which is ¾$^{th}$ or less of a circle, the upper wall and the bottom wall extending from the connecting wall such that the channel defined therebetween has generally the same shape as the upper wall.

2. The support bracket of claim 1, wherein the inner surface of the first portion of the connecting wall is straight and is disposed at angle of approximately 270 degrees relative to the inner surface of the second portion of the connecting wall when measured along the channel, the inner surface of the second portion also being straight.

3. The support bracket of claim 1, wherein the guide is disposed at a first distance relative to the first end of the connecting wall and the engagement member is disposed at a second distance relative to the second end of the engagement wall, and wherein the first distance is greater than the second distance.

4. A support bracket for supporting a shelf, comprising:

a channel defined by an upper wall, a bottom wall, and a connecting wall, the connecting wall having an inner surface extending along the channel;

a guide located on a first portion of the connecting wall;

an engagement member located on a second portion of the connecting wall; and wherein the upper wall and the bottom wall are connected by the first portion of the connecting wall and the second portion of the connecting wall without an intervening connecting wall along the channel and wherein the inner surface disposed along the first portion of the connecting wall and the inner surface extending along the second portion of the connecting wall are disposed at an obtuse angle when measured along the channel; and wherein the first portion has an outer surface and wherein the guide is an aperture formed through the outer surface and the inner surface of the first portion of the connecting wall so that the aperture opens into the channel, wherein the upper wall has a generally arcuate outer perimeter and the bottom wall has a generally arcuate outer perimeter which define a shape of the channel.

5. The support bracket of claim 1, wherein the engagement member is selected from the group consisting of a dowel pin, rod, and peg.

6. A shelving system comprising the bracket of claim 1, and further comprising:

a first structural element having an upper surface and an outer edge and a second structural element having an upper surface and an outer edge, the first structural element and the second structural element abutting one another so as to form an angle complimentary to the angle of the channel between the inner surface of the first portion and the inner surface of the second portion; and wherein the first structural element and the second structural element extend into the channel and are held by the upper wall and the bottom wall.

7. The shelving system of claim 6, further comprising a receiving member and wherein the inner surface on the first portion is substantially flush with the outer edge of the first structural element and wherein the inner surface on the second portion is substantially flush with the outer edge of the second structural element when the engagement member of the bracket is fully engaged with the receiving member.

8. The shelving system of claim 6, wherein the guide is disposed at a first distance relative to a first end of the connecting wall and the engagement member is disposed at a second distance relative to a second end of the engagement wall, and wherein the first distance is greater than the second distance.

9. The shelving system of claim 8, wherein the engagement member has a length and wherein the difference between the first distance and the second distance is about the length of the engagement member.

10. The shelving system of claim 6, wherein the upper wall and the bottom wall each have an outer edge which is generally arcuate but forms less than a complete circle, the outer edge of the upper wall and the outer edge of the bottom wall defining a shape of the channel.

11. The shelving system of claim 6, wherein the bracket is releasably engaged with the first structural element and the second structural element.

12. The support bracket of claim 1, wherein the upper wall forms an arcuate shape defining the channel, the arcuate shape being less than a circle and the bottom wall forms an arcuate shape defining the channel, the arcuate shape being less than a circle.

13. A support bracket for supporting a shelf, comprising:

a channel defined by an upper wall, a bottom wall, and a connecting wall, the connecting wall having a first portion with an inner surface along the channel and a second portion with an inner surface along the channel;

a guide located on a first portion of the connecting wall; and an engagement member located on a second portion of the connecting wall; and wherein the upper wall and the bottom wall are connected by the first portion of the connecting wall and the second portion of the connecting wall without an intervening connecting wall along the channel and wherein the first portion of the connecting wall and the second portion of the connecting wall are disposed at an obtuse angle between the inner surface of the first portion and the inner surface of the second portion measured in the channel; and wherein the upper wall and the bottom wall each form a shape which is ¾ths of a circle and wherein the connecting wall is formed with a 90 degree bend.

14. The Support bracket of claim 13, wherein the first portion of the connecting wall is disposed at angle of approximately 270 degrees relative to the second portion of the connecting wall when measured along the channel.

15. The support bracket of claim 13, wherein the upper wall and the bottom wall are each formed in a pie shape which is ¾ths or less of a circle.

16. The support bracket of claim 13, wherein the guide is disposed at a first distance relative to the first end of the connecting wall and the engagement member is disposed at a second distance relative to the second end of the engagement wall, and wherein the first distance is greater than the second distance.

17. The support bracket of claim 13, wherein the engagement member is selected from the group consisting of a dowel pin, rod, and peg.

* * * * *